US009828866B2

(12) United States Patent
Fitts et al.

(10) Patent No.: US 9,828,866 B2
(45) Date of Patent: Nov. 28, 2017

(54) METHODS AND SYSTEMS FOR SECURING TURBINE NOZZLES

(71) Applicant: General Electric Company, Schenectady, NY (US)

(72) Inventors: David Orus Fitts, Ballston Spa, NY (US); David Robert Schumacher, Scotia, NY (US); Laurence Scott Duclos, Thorndike, ME (US); Anand Aravindrao Kulkarni, Karnataka (IN); David Bruce Knorr, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 1064 days.

(21) Appl. No.: 14/068,544

(22) Filed: Oct. 31, 2013

(65) Prior Publication Data

US 2015/0118041 A1 Apr. 30, 2015

(51) Int. Cl.

| | |
|---|---|
| ***F01D 9/04*** | (2006.01) |
| ***F01D 5/30*** | (2006.01) |
| ***F01D 5/32*** | (2006.01) |

(52) U.S. Cl.

CPC ..... *F01D 9/042* (2013.01); *F01D 5/3046* (2013.01); *F01D 5/32* (2013.01); *Y10T 29/49321* (2015.01)

(58) Field of Classification Search

CPC ..... F01D 9/042; F01D 5/32; F01D 5/3046; F01D 5/3038; F01D 5/303; F01D 5/3053; Y10T 29/49321

See application file for complete search history.

(56) References Cited

U.S. PATENT DOCUMENTS

| | | | | |
|---|---|---|---|---|
| 3,326,523 | A * | 6/1967 | Bobo | F01D 9/042 415/209.3 |
| 6,722,848 | B1 | 4/2004 | Couture et al. | |
| 6,761,538 | B2 * | 7/2004 | Fitts | F01D 5/3038 416/221 |
| 6,786,699 | B2 * | 9/2004 | Shapiro | B23P 15/006 29/889.21 |
| 6,908,279 | B2 * | 6/2005 | Sullivan | F01D 9/042 29/889.22 |
| 7,410,345 | B2 | 8/2008 | Bracken | |
| 8,052,380 | B2 * | 11/2011 | Willett, Jr. | F01D 5/225 415/114 |

* cited by examiner

*Primary Examiner* — Dwayne J White
*Assistant Examiner* — Adam W Brown
(74) *Attorney, Agent, or Firm* — Armstrong Teasdale LLP

(57) ABSTRACT

A nozzle assembly includes at least one stationary nozzle and an outer ring having a predefined shape. The outer ring includes at least one groove defined therein configured to receive at least a portion of the at least one stationary nozzle. The nozzle assembly also includes an attachment member coupled between the stationary nozzle and the outer ring. The attachment member has a first configuration at a first nozzle assembly operating temperature a second configuration at a second nozzle assembly operating temperature.

20 Claims, 3 Drawing Sheets

METHODS AND SYSTEMS FOR SECURING TURBINE NOZZLES

BACKGROUND

The present invention relates generally to turbine engines, and more particularly, to systems and methods for securing turbine nozzles within a turbine carrier groove.

At least some known turbine engines, such as gas turbines and steam turbines, include a carrier for axially spaced, circumferential arrays of nozzles. The carrier typically includes carrier halves which extend arcuately 180° and are secured to one another at a horizontal joint face to form a 360° array of nozzles at each axial stage position. Typically, the nozzles include an airfoil having a dovetail-shaped base that is inserted in a corresponding dovetail-shaped groove in the carrier. When the nozzles are installed in each carrier half groove, the nozzle bases are stacked one against the other within the grooves forming a semi-circular array of nozzles.

One known method of retaining the nozzles within the grooves includes using shims to secure the nozzle in the proper position. However, shims have to be accurately cut and selectively assembled to fit each nozzle. If the shims are not accurately cut, the nozzle may jam when being installed over the shims, resulting in decreased efficiency of operation. Using shims is also a time consuming and labor intensive process, which may cause an increase in manufacturing costs.

Another known method of retaining the nozzles within the grooves includes using radial loading pins to secure each nozzle. With such method, a pin is disposed between the base of the nozzle and the base of the groove to bias the nozzle radially inwardly. The pins are typically made from steel to have high strength at room temperature assembly conditions, and high strength at high temperature operating conditions. Because of the pin material and the dovetail geometry of known nozzles, high stresses exist in the nozzle dovetail hook and an upstream ligament of the outer ring which holds the nozzle.

BRIEF DESCRIPTION

In one aspect, a nozzle assembly is provided. The nozzle assembly includes at least one stationary nozzle and an outer ring having a predefined shape. The outer ring includes at least one groove defined therein configured to receive at least a portion of the at least one stationary nozzle. The nozzle assembly also includes an attachment member coupled between the stationary nozzle and the outer ring. The attachment member has a first configuration at a first nozzle assembly operating temperature a second configuration at a second nozzle assembly operating temperature.

In another aspect, a rotary machine is provided. The rotary machine includes a rotor and at least one nozzle assembly coupled to the rotor. The nozzle assembly includes at least one stationary nozzle and an outer ring having a predefined shape. The outer ring includes at least one groove defined therein configured to receive at least a portion of the at least one stationary nozzle. The nozzle assembly also includes an attachment member coupled between the stationary nozzle and the outer ring. The attachment member has a first configuration at a first nozzle assembly operating temperature a second configuration at a second nozzle assembly operating temperature.

In yet another aspect, a method of assembling a rotary machine is provided. The method includes coupling at least one stationary nozzle to a rotor such that the at least one stationary nozzle extends radially outwardly from the rotor and coupling an outer ring having a predefined shape to the rotor such that the outer ring substantially circumscribes the rotor. The outer ring includes at least one groove defined therein, the groove configured to receive at least a portion of the at least one stationary nozzle therein. The method also includes coupling an attachment member between the at least one stationary nozzle and the outer ring. The attachment member has a first configuration at a first nozzle assembly operating temperature, and has a second configuration at a second nozzle assembly operating temperature.

DETAILED DESCRIPTION

As used herein, the terms "axial" and "axially" refer to directions and orientations extending substantially parallel to a longitudinal axis of a turbine engine. Moreover, the terms "radial" and "radially" refer to directions and orientations extending substantially perpendicular to the longitudinal axis of the turbine engine. In addition, as used herein, the terms "circumferential" and "circumferentially" refer to directions and orientations extending arcuately about the longitudinal axis of the turbine engine.

Figure 1:
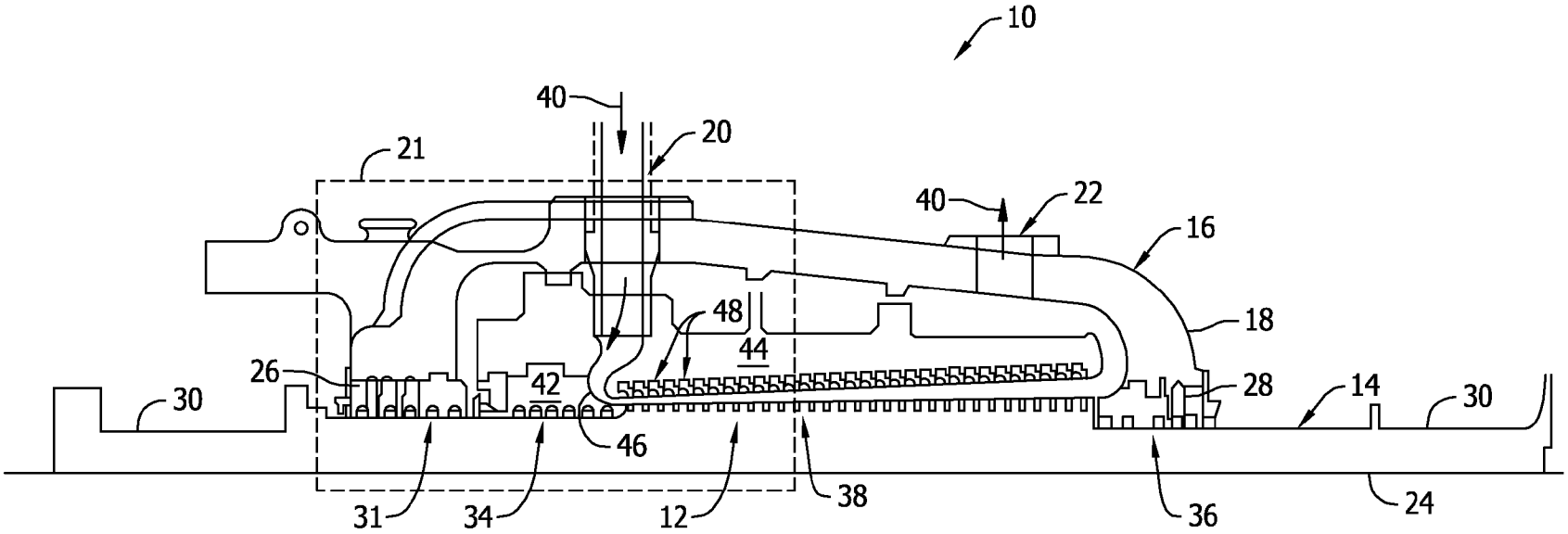
FIG. 1 is a schematic view of an exemplary steam turbine engine.

FIG. 1 is a schematic view of an exemplary steam turbine engine 10. While FIG. 1 describes an exemplary steam turbine engine, it should be noted that the nozzle attachment member, systems, and methods described herein are not limited to any one particular type of turbine engine. One of ordinary skill in the art will appreciate that the current nozzle attachment member, systems, and methods described herein may be used with any rotary machine, including a gas turbine engine, in any suitable configuration that enables such an apparatus, system, and method to operate as further described herein.

In the exemplary embodiment, steam turbine engine 10 is a single-flow steam turbine engine. Alternatively, steam turbine engine 10 may be any type of steam turbine, such as, without limitation, a low-pressure turbine engine, an opposed-flow high-pressure and intermediate-pressure steam turbine combination, a double-flow steam turbine engine, and/or other steam turbine types. Moreover, as discussed above, the present invention is not limited to only being used in steam turbine engines and can be used in other turbine systems, such as gas turbine engines.

In the exemplary embodiment shown in FIG. 1, steam turbine engine 10 includes a plurality of turbine stages 12 that are coupled to a rotor 14. A casing 16 is divided axially into an upper half section 18 and a lower half section (not shown). The upper half section 18 includes a high pressure (HP) steam inlet 20 at a high pressure (HP) section 21, and a low pressure (LP) steam outlet 22. Rotor 14 extends through casing 16 along a centerline axis 24. Rotor 14 is supported in casing 16 by journal bearings 26 and 28, respectively, that are each rotatably coupled to opposite end portions 30 of rotor 14. A plurality of sealing members 31, 34, and 36 are coupled between rotor end portions 30 and casing 16 to facilitate sealing casing 16 about rotor 14.

In the exemplary embodiment, steam turbine engine 10 also includes a stator component 42 coupled to an inner shell 44 of casing 16. The plurality of sealing members 34 are coupled to stator component 42. Casing 16, inner shell 44, and stator component 42 each extend circumferentially about rotor 14 and sealing members 34. In the exemplary embodiment, sealing members 34 form a tortuous sealing path between stator component 42 and rotor 14. Rotor 14 includes a plurality of turbine stages 12 through which high-pressure high-temperature steam 40 is passed via steam channel 46. Turbine stages 12 include a plurality of inlet nozzles 48. Steam turbine engine 10 may include any number of inlet nozzles 48 that enables steam turbine engine 10 to operate as described herein. For example, steam turbine engine 10 may include more or fewer inlet nozzles 48 than shown in FIG. 1. Turbine stages 12 also include a plurality of turbine blades or buckets, generally indicated at 38. Steam turbine engine 10 may include any number of buckets 38 that enables steam turbine engine 10 to operate as described herein. For example, steam turbine engine 10 may include more or fewer buckets 38 than are illustrated in FIG. 1. Steam channel 46 typically passes through casing 16. Steam 40 enters steam channel 46 through HP steam inlet 20 and passes down the length of rotor 14 through turbine stages 12.

During operation, high pressure and high temperature steam 40 is channeled to turbine stages 12 from a steam source, such as a boiler (not shown), wherein thermal energy is converted to mechanical rotational energy by turbine stages 12. More specifically, steam 40 is channeled through casing 16 from HP steam inlet 20 where it impacts the plurality of buckets 38 coupled to rotor 14 to induce rotation of rotor 14 about centerline axis 24. Steam 40 exits casing 16 at LP steam outlet 22. Steam 40 may then be channeled to the boiler (not shown) where it may be reheated or channeled to other components of the system, e.g., a condenser (not shown).

Figure 2:
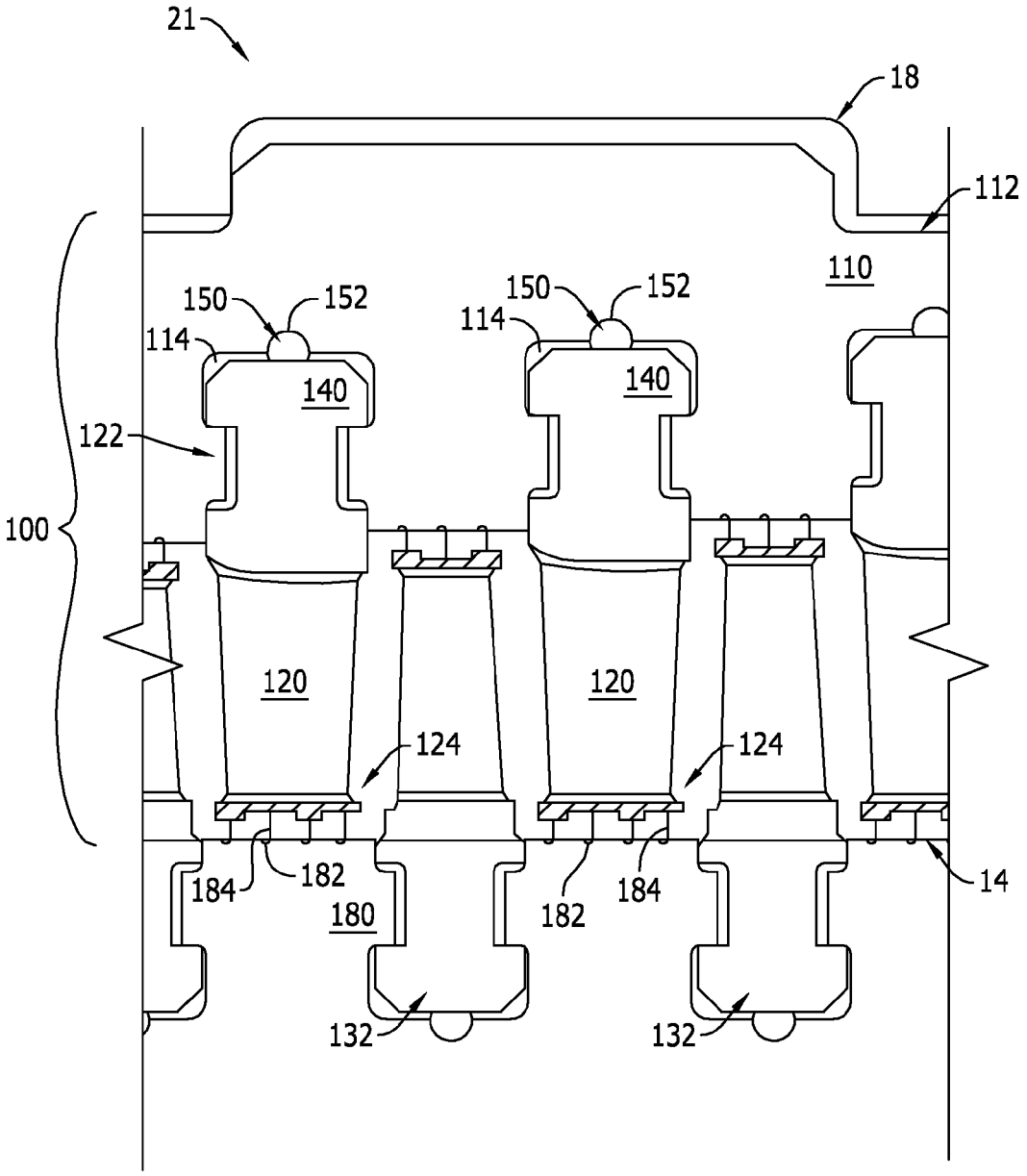
FIG. 2 is a cross-sectional schematic view of a high pressure (HP) section of the steam turbine engine shown in FIG. 1.
Figure 3:
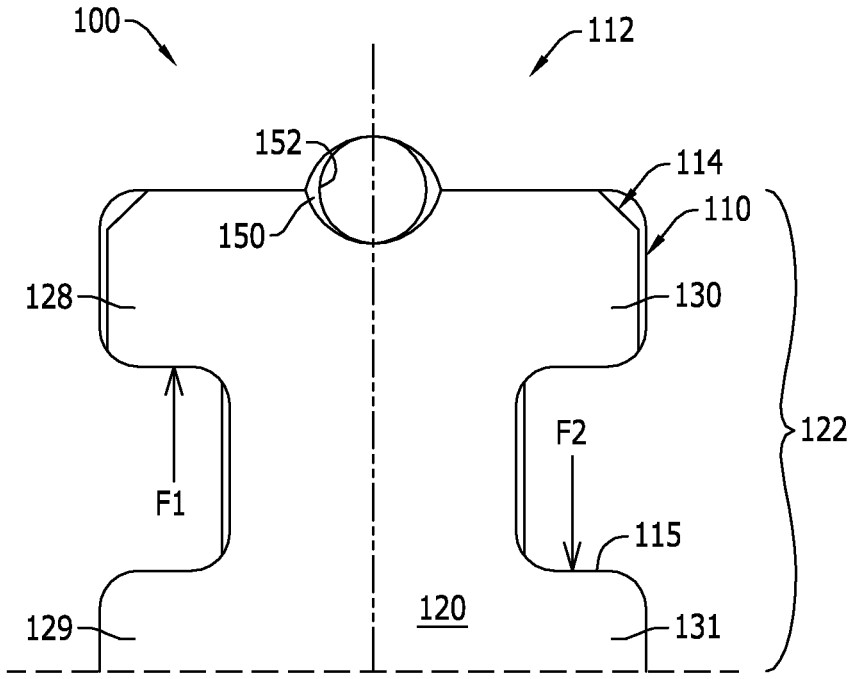
FIG. 3 is a cross-sectional schematic view of a portion of an exemplary nozzle assembly that may be used with the HP section shown in FIG. 2.

FIG. 2 is a cross-sectional schematic view of HP section 21 of steam turbine engine 10 (shown in FIG. 1). FIG. 3 is a cross-sectional schematic view of a portion of an exemplary nozzle assembly 100 that may be used with HP section 21 of steam turbine engine 10 and taken along area 3 (shown in FIG. 2). In the exemplary embodiment, HP section 21 includes upper half casing 18 (shown in FIG. 1) that is coupled to a lower half casing (not shown) when engine 10 is fully assembled. HP section 21 includes at least one nozzle assembly 100 that includes a substantially annular outer or blinglet ring 110 that substantially circumscribes rotor 14 (shown in FIG. 1). Further, in the exemplary embodiment, a top half 112 of ring 110 is coupled against radially inner surfaces of upper half casing 18 such that ring top half 112 acts as a radial inward extension of casing 18. Such coupling facilitates maintaining top half 112 of ring 110 in a substantially fixed position with respect to rotor 14. Top half 112 of ring 110 also includes at least one groove 114 defined therein.

Moreover, in the exemplary embodiment, nozzle assembly 100 includes at least one stationary nozzle 120. Groove 114 is sized and oriented to receive at least a portion of nozzle 120 therein. More specifically, in the exemplary embodiment, nozzle assembly 100 includes grooves 114 defined within ring top half 112, and each groove 114 is sized and oriented to receive nozzle 120 therein. In the exemplary embodiment, each nozzle 120 includes a first end portion 122 and a second end portion 124 that is opposite first end portion 122. In the exemplary embodiment, each first end portion 122 is dovetailed and includes a first, or upstream, hook portion 128, a second upstream hook portion 129, a first downstream hook portion 130 and a second downstream, hook portion 131. A bottom half (not shown) of ring 110 is coupled to the lower half casing and receives nozzles 120 in a manner similar to ring top half 112. HP section 21 also includes a plurality of rotatable buckets 132 that are securely coupled to rotor 14.

In the exemplary embodiment, a coupling portion 140 extends from each nozzle first end portion 122. More specifically, in the exemplary embodiment, each coupling portion 140 is formed integrally with respective nozzle first end portion 122 such that nozzle 120 and coupling portion 140 are a unitary component. Coupling portion 140 may be formed with nozzle 120 via a variety of known manufacturing processes known in the art, such as, but not limited to, molding process, drawing process or a machining process. One or more types of materials may be used to fabricate coupling portion 140 and/or nozzle 120 with the materials selected based on suitability for one or more manufacturing techniques, dimensional stability, cost, moldability, workability, rigidity, and/or other characteristic of the material(s). For example, coupling portion 140 and/or nozzle 120 may be fabricated from a metal, such as an alloy steel and/or a nickel based material.

In the exemplary embodiment, coupling portion 140 is integrally formed with, and is positioned adjacent to, nozzle first end portion 122. Coupling portion 140 is positioned adjacent to groove 114. Coupling portion first end 142, in the exemplary embodiment, includes an arcuate groove 150 defined therein. Groove 150 is sized and oriented to receive an attachment member 152 therein. In the exemplary embodiment, one attachment member 152 is positioned within each groove 150. In the exemplary embodiment, attachment member 152 is a pin or bolt that couples at least a portion of nozzle first end portion 122 to at least a portion of ring groove 114 such that nozzle 120 and outer ring 110 are securely coupled together.

Moreover, in the exemplary embodiment, rotor 14 includes a rotor surface 180 that includes a plurality of substantially annular rotor grooves 182 formed therein. At least one substantially arcuate sealing strip 184 is securely coupled within each rotor groove 182. In the exemplary embodiment, nozzle second end portion 124 is positioned adjacent to sealing strips 184. In the exemplary embodiment, sealing strips 184 substantially reduce an amount of fluid flowpath leakage that may occur between rotor 14 and casing 18.

Figure 4:
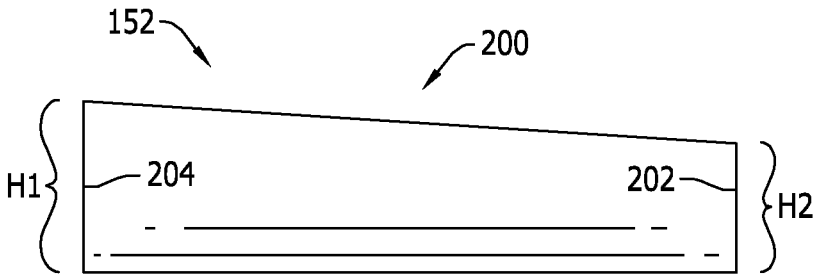
FIG. 4 is a side view of an exemplary attachment member that may be used with the nozzle assembly shown in FIG. 3.

FIG. 4 is a side view of an exemplary attachment member 152 (shown in FIG. 3) that may be used with nozzle assembly 100 (shown in FIG. 3). In the exemplary embodiment, attachment member 152 is generally wedge-shaped, having a part cylindrical cross-sectional shape (shown in FIG. 3) and a graduated, i.e., inclined or stepped, wall portion 200. Attachment member 152 has a wall portion 200 that is substantially continuously inclined from a first, insert end 202 to a second, proximal end 204 to define a generally tapered or wedge shaped attachment member 152. A height H1 of attachment member 152 at insert end 202 is less than a height H2 of attachment member 152 at proximal end 204. Moreover, a cross sectional area (not shown) of attachment member 152 at insert end 202 is less than a cross sectional area (not shown) of attachment member 152 at proximal end 204. Although wall portion 200 is illustrated as a continuously tapered surface, a wall portion comprising a plurality of steps so as to define an effectively continuously inclined surface would be functionally equivalent thereto. Attachment member 152 is inserted into arcuate groove 150 between ring 110 and nozzle 120. Attachment member 152 provides a wedge contact for radially loading nozzle 120 inward against first and second hook portions 128 and 130 with sufficient force to maintain a designed airfoil pre-twist.

In the exemplary embodiment, attachment member 152 is fabricated using a material that has sufficient tensile strength at ambient temperature during assembly to hold nozzles 120 in position, and decreases in tensile strength at high temperature operating conditions (e.g., above about 400° C.). More specifically, in the exemplary embodiment, attachment member 152 is fabricated using brass, brass alloy, copper, copper alloy, and/or any other material known in the art that enables attachment member 152 to function as described herein.

In the exemplary embodiment, attachment member 152 has a first configuration at a first nozzle assembly operating temperature a second configuration at a second nozzle assembly operating temperature. Attachment member 152 is configured to radially bias nozzle 120 a distance from ring 110 while in the first configuration. Attachment member 152 creates a gap between nozzle 120 and ring 110 while in the first configuration. Attachment member 152 transforms to the second configuration at the second nozzle assembly operating temperature, which is higher than the first nozzle assembly operating temperature. When attachment member 152 transforms to the second configuration, nozzle 120 moves and contacts ring 110, thereby closing the gap.

During operation, steam enters HP section 21 via HP section steam inlet 20 (shown in FIG. 1) and is channeled through HP section 21. Inlet nozzle 48 (shown in FIG. 1) and nozzles 120 channel steam to buckets 132. As steam is channeled to nozzles 120 and to buckets 132, pressure from the steam induces forces to nozzles 120 and buckets 132. More specifically, the pressure drops within HP section 21 and various forces, such as radial forces, are induced to nozzles 120 and buckets 132. For example, steam induces a first radial force F1 to first hook portion 128 on the upstream side of nozzle 120. Attachment member 152 loses tensile strength and deforms with increasing operating temperatures increases. When attachment member 152 deforms, nozzle 120 slightly changes position within groove 114. Hook portions 128 and 130 make contact with ring 110. Second downstream hook portion 131 makes contact with a lower radial outward groove 115 of ring 110. When contact is made, at least a portion of first radial force F1 is transferred to the contact between second downstream hook portion 131 and lower radial outward groove 115 as a second radial force F2. Second radial force F2 is in a direction opposite from first radial force F1. As a result, a load path supporting nozzle 120 changes, reducing stress forces on upstream hook portion 128 and reducing stress forces on ring 110. When the radial load path transitions from going through pin 152 to load surface 115, upstream reaction force F1 is reduced by approximately half, thus reducing the stress in upstream hook portion 128 and an upstream ligament portion of ring 112 by approximately half.

A technical effect of the systems and methods described herein includes at least one of: (a) coupling at least one stationary nozzle to a rotor such that the at least one stationary nozzle extends radially outwardly from the rotor; (b) coupling an outer ring having a predefined shape to the rotor such that the outer ring substantially circumscribes the rotor, the outer ring includes at least one groove defined therein, the at least one groove configured to receive at least a portion of the at least one stationary nozzle therein; and (c) coupling an attachment member between the at least one stationary nozzle and the outer ring, the attachment member having a first configuration at a first nozzle assembly operating temperature, and having a second configuration at a second nozzle assembly operating temperature.

The systems and methods described herein facilitate improving turbine engine performance by providing nozzle assembly attachment member that substantially reduces operating stresses induced to the turbine. Specifically, an attachment member having a first configuration at a first nozzle assembly operating temperature and a second configuration at a second nozzle assembly operating temperature is described. The attachment member radially biases a nozzle relative to a turbine casing while in the first configuration and transforms to a second configuration at a higher operating temperature to move operating stresses off of the attachment member and the casing, and onto a contact surface where a nozzle hook contacts the casing. Therefore, in contrast to known turbines that use shims to reduce operating stresses, the apparatus, systems, and methods described herein facilitate reducing the time and difficulty in assembling nozzle assemblies, facilitate reducing operating stresses and cost associated with nozzle assemblies, and enable coupling at the nozzle base to reduce dynamic stresses in the dovetail.

The methods and systems described herein are not limited to the specific embodiments described herein. For example, components of each system and/or steps of each method may be used and/or practiced independently and separately from other components and/or steps described herein. In addition, each component and/or step may also be used and/or practiced with other assemblies and methods.

While the invention has been described in terms of various specific embodiments, those skilled in the art will recognize that the invention can be practiced with modification within the spirit and scope of the claims.

What is claimed is:

1. A nozzle assembly comprising:

at least one stationary nozzle;

an outer ring having a predefined shape, said outer ring comprising at least one groove defined therein, said at least one outer ring groove configured to receive at least a portion of said at least one stationary nozzle therein; and an attachment member coupled between said at least one stationary nozzle and said outer ring, said attachment member having a first configuration at a first nozzle assembly operating temperature, and having a second configuration at a second nozzle assembly operating temperature, wherein said attachment member in the first configuration creates a gap between said at least one stationary nozzle and said outer ring, and said attachment member in the second configuration is transformed such that said at least one stationary nozzle contacts said outer ring.

2. A nozzle assembly in accordance with claim 1, wherein said attachment member is fabricated from a brass material.

3. A nozzle assembly in accordance with claim 1, wherein said attachment member is fabricated from a copper material.

4. A nozzle assembly in accordance with claim 1, wherein said attachment member is configured to radially bias said at least one stationary nozzle a distance from said outer ring while in the first configuration to define said gap.

5. A nozzle assembly in accordance with claim 1, wherein said attachment member is transformable from the first configuration to the second configuration in response to the second nozzle assembly operating temperature.

6. A nozzle assembly in accordance with claim 1, wherein said at least one stationary nozzle comprises an end portion comprising a substantially arcuate groove defined therein, said groove configured to receive said attachment member therein.

7. A nozzle assembly in accordance with claim 1, wherein said at least one outer ring groove defines a substantially arcuate groove, said arcuate groove configured to receive said attachment member therein.

8. A nozzle assembly in accordance with claim 1, wherein said attachment member comprises a loading pin extending between said at least one stationary nozzle and said outer ring.

9. A nozzle assembly in accordance with claim 1, wherein said at least one stationary nozzle comprises an end portion coupled within said at least one outer ring groove, said end portion comprises a dovetailed end portion.

10. A rotary machine comprising:

a rotor; and at least one nozzle assembly coupled to said rotor, said at least one nozzle assembly comprising:

at least one stationary nozzle extending radially outwardly from said rotor;

an outer ring having a predefined shape and said outer ring substantially circumscribes said rotor, wherein said outer ring comprises at least one groove defined therein, said at least one outer ring groove is configured to receive at least a portion of said at least one stationary nozzle therein; and an attachment member coupled between said at least one stationary nozzle and said outer ring, said attachment member having a first configuration at a first nozzle assembly operating temperature, and having a second configuration at a second nozzle assembly operating temperature, wherein said attachment member in the first configuration creates a gap between said at least one stationary nozzle and said outer ring, and said attachment member in the second configuration is transformed such that said at least one stationary nozzle contacts said outer ring.

11. A rotary machine in accordance with claim 10, wherein said attachment member is configured to radially bias said at least one stationary nozzle a distance from said outer ring while in the first configuration to define said gap.

12. A rotary machine in accordance with claim 11, wherein said attachment member is transformable from the first configuration to the second configuration in response to the second nozzle assembly operating temperature, wherein the second nozzle assembly operating temperature is higher than the first nozzle assembly operating temperature.

13. A rotary machine in accordance with claim 12, wherein said at least one stationary nozzle comprises an end portion comprising a substantially arcuate groove defined therein, said groove configured to receive said attachment member therein.

14. A rotary machine in accordance with claim 10, wherein said attachment member is fabricated from one of a brass material and a copper material.

15. A method of assembling a rotary machine, said method comprising:

coupling at least one stationary nozzle to a rotor such that the at least one stationary nozzle extends radially outwardly from the rotor;

coupling an outer ring having a predefined shape to the rotor such that the outer ring substantially circumscribes the rotor, the outer ring includes at least one groove defined therein, the at least one groove configured to receive at least a portion of the at least one stationary nozzle therein; and coupling an attachment member between the at least one stationary nozzle and the outer ring, the attachment member having a first configuration at a first nozzle assembly operating temperature, and having a second configuration at a second nozzle assembly operating temperature, wherein the attachment member in the first configuration creates a gap between the at least one stationary nozzle and the outer ring, and the attachment member in the second configuration is transformed such that the at least one stationary nozzle contacts the outer ring.

16. A method of assembling a rotary machine in accordance with claim 15, wherein coupling an attachment member further comprises radially biasing the at least one stationary nozzle a distance from the outer ring while in the first configuration to define the gap.

17. A method of assembling a rotary machine in accordance with claim 16, wherein coupling an attachment member further comprises coupling the attachment member that is transformable from the first configuration to the second configuration in response to the second nozzle assembly operating temperature, wherein the second nozzle assembly operating temperature is higher than the first nozzle assembly operating temperature.

18. A method of assembling a rotary machine in accordance with claim 17, wherein coupling an attachment member further comprises coupling an attachment member that includes a loading pin fabricated from one of a brass material and a copper material.

19. The nozzle assembly in accordance with claim 1, wherein the second nozzle assembly operating temperature is higher than the first nozzle assembly operating temperature.

20. The rotary machine of claim 10, wherein the second nozzle assembly operating temperature is higher than the first nozzle assembly operating temperature.

* * * * *